US009450337B2

(12) United States Patent
Kao et al.

(10) Patent No.: US 9,450,337 B2
(45) Date of Patent: Sep. 20, 2016

(54) ELECTRICAL PLUG CONNECTOR

(71) Applicant: Advanced-Connectek Inc., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/837,020

(22) Filed: Aug. 27, 2015

(65) Prior Publication Data

US 2016/0064864 A1 Mar. 3, 2016

(30) Foreign Application Priority Data

Aug. 28, 2014 (TW) ..... 103129757 A

(51) Int. Cl.

| | |
|---|---|
| ***H01R 13/648*** | (2006.01) |
| ***H01R 13/6461*** | (2011.01) |
| ***H01R 13/627*** | (2006.01) |
| *H01R 13/6585* | (2011.01) |
| *H01R 24/60* | (2011.01) |

(52) U.S. Cl.

CPC ..... *H01R 13/6461* (2013.01); *H01R 13/6275* (2013.01); *H01R 13/6585* (2013.01); *H01R 24/60* (2013.01)

(58) Field of Classification Search

CPC ..... H01R 13/6461; H01R 13/6585; H01R 13/665; H01R 13/658; H01R 13/6592; H01R 13/6587; H01R 13/6593; H01R 13/504; H01R 13/6586; H01R 23/02

USPC ..... 439/607.05, 607.41, 607.46, 607.51, 439/607.55, 607.57, 660

See application file for complete search history.

(56) References Cited

U.S. PATENT DOCUMENTS

| | | | | |
|---|---|---|---|---|
| RE35,896 E * | 9/1998 | Brunker | H01R 23/688 | 439/101 |
| 6,074,225 A * | 6/2000 | Wu | H01R 23/6873 | 439/101 |
| 6,669,499 B2 * | 12/2003 | Whyne | H01R 13/112 | 439/342 |
| 7,758,379 B2 * | 7/2010 | Chen | H01R 13/6485 | 439/607.11 |
| 8,684,769 B2 * | 4/2014 | Kao | H01R 13/6471 | 439/607.28 |
| 8,968,031 B2 * | 3/2015 | Simmel | H01R 13/659 | 439/108 |
| 9,022,800 B2 * | 5/2015 | Yang | H01R 13/6581 | 439/487 |

(Continued)

*Primary Examiner* — Neil Abrams
*Assistant Examiner* — Travis Chambers
(74) *Attorney, Agent, or Firm* — Alan D. Kamrath; Kamrath IP Lawfirm, P.A.

(57) ABSTRACT

An electrical plug connector includes an insulating housing, two terminal sets, and a metallic component. The insulating housing includes a front portion and a rear portion, and a receiving cavity is formed inside the front portion. The two terminal sets separately include a plurality of terminals and are arranged in an upper-row terminal set and a lower-row terminal set. Each terminal includes a contact portion disposed in the receiving cavity, a retaining portion retained in the insulating housing, and a soldering portion disposed in the rear of the insulating housing. The metallic component includes a plate body and two latches. The plate body is disposed in the rear portion and clamped between the upper-row and lower-row terminal sets. The two latches are separately disposed at two sides of the plate body and symmetrical to each other. The plate body and the two latches are formed in one piece.

20 Claims, 14 Drawing Sheets

(56) References Cited

U.S. PATENT DOCUMENTS 9,281,582 B2 * 3/2016 Hou ..... H01R 12/707
2014/0187086 A1 * 7/2014 Little ..... H01R 13/6585 439/607.34
2015/0171561 A1 * 6/2015 Little ..... H01R 24/60 439/607.34
2015/0171562 A1 * 6/2015 Gao ..... H01R 13/6582 439/345
2015/0171574 A1 * 6/2015 Little ..... H01R 24/60 439/78
2015/0194772 A1 * 7/2015 Little ..... H01R 13/6597 439/357
2015/0200504 A1 * 7/2015 Little ..... H01R 24/60 439/345
2015/0207280 A1 * 7/2015 Little ..... H01R 24/60 439/607.34
2015/0222059 A1 * 8/2015 Little ..... H01R 13/6587 439/607.55
2015/0229077 A1 * 8/2015 Little ..... H01R 13/6582 439/78
2015/0270646 A1 * 9/2015 Kao ..... H01R 13/6581 439/76.1
2015/0295362 A1 * 10/2015 Tziviskos ..... H01R 13/6581 439/607.01
2016/0013566 A1 * 1/2016 Wu ..... H01R 4/023 439/676
2016/0013599 A1 * 1/2016 Ueda ..... H01R 13/6596 439/607.01
2016/0043512 A1 * 2/2016 Kao ..... H01R 13/665 439/620.22
2016/0049751 A1 * 2/2016 Chuang ..... H01R 13/642 439/217
2016/0056583 A1 * 2/2016 Chuang ..... H01R 13/6581 439/607.01
2016/0064868 A1 * 3/2016 Little ..... H01R 13/6581 439/607.01
2016/0079689 A1 * 3/2016 Wu ..... H01R 9/0515 439/581

* cited by examiner

ELECTRICAL PLUG CONNECTOR

BACKGROUND OF THE INVENTION

1. Field of the Invention

The present invention relates to an electrical connector and, more particularly, to an electrical plug connector.

2. Description of the Prior Art

The conventional electrical plug connector includes an insulating housing, a plurality of terminals, a circuit board, a metallic shield plate, and two latches. A receiving cavity is formed in the front of the insulating housing and used to receive a mating electrical receptacle connector. The terminals are retained in the insulating housing and arranged as upper-row and lower-row terminals. The front and the rear of each terminal are a contact portion and a soldering portion, respectively. The contact portions are disposed in the receiving cavity and used to electrically contact with another plurality of terminals of the mating electrical receptacle connector. The soldering portions extend backwardly from the rear of the insulating housing and are used to be soldered on the circuit board. The metallic shield plate is disposed in the insulating housing and retained between the upper-row and lower-row terminals to reduce crosstalk therebetween. The two latches are separately engaged at two sides of the insulating housing and used to secure a tongue of the electrical receptacle connector and ground. In the conventional technology, it is necessary to separately produce the metallic shield plate and the latches and to assemble them with the insulating housing, resulting in high production costs and in complex assembly processes.

SUMMARY OF THE INVENTION

The present invention provides an electrical plug connector to reduce production costs and to simplify assembly processes.

According to an aspect of the present invention, there is provided an electrical plug connector including an insulating housing, two terminal sets, a circuit board, and a metallic component. The insulating housing includes a front portion and a rear portion. The front portion extends forwardly from the rear portion, and a receiving cavity is formed inside the front portion. The front portion includes an upper inner side, a left inner side, a lower inner side, and a right inner side. The upper inner side, the left inner side, the lower inner side, and the right inner side surround and form the receiving cavity. The two terminal sets separately include a plurality of terminals and are arranged in an upper-row terminal set and a lower-row terminal set. The upper-row terminal set and the lower-row terminal set are symmetrical to each other about the center line of the receiving cavity as the symmetrical center. Each terminal includes a contact portion, a retaining portion, and a soldering portion. The retaining portions are retained in the insulating housing, the soldering portions are disposed in the rear of the insulating housing, and the contact portions are disposed in the receiving cavity. The contact portions of the upper-row terminal set and the lower-row terminal set are disposed on the upper inner side and the lower inner side, respectively. The circuit board is placed between the soldering portions of the upper-row terminal set and the lower-row terminal set. The metallic component includes a plate body and two latches. The plate body is disposed in the rear portion and retained between the upper-row terminal set and the lower-row terminal set. The two latches are separately disposed at two sides of the plate body and symmetrical to each other. The plate body and the two latches are formed in one piece. Each latch includes an engaging portion, a connecting portion, and a grounding portion. The connecting portions are connected to the plate body, the engaging portions project into the receiving cavity and are separately disposed corresponding to the left inner side and the right inner side, and the grounding portions are disposed in the rear of the insulating housing and on a surface of the circuit board. The plate body and the two latches are formed in a blanking-type component.

The electrical plug connector provided by the present invention, with the metallic component including the plate body and the latches together formed in one piece, may reduce production costs and simplify assembly processes.

DESCRIPTION OF THE PREFERRED EMBODIMENTS

The foregoing, as well as additional objects, features and advantages of the present invention will be more readily apparent from the following embodiments and detailed description, which proceed with reference to the accompanying drawings.

Figure 1:
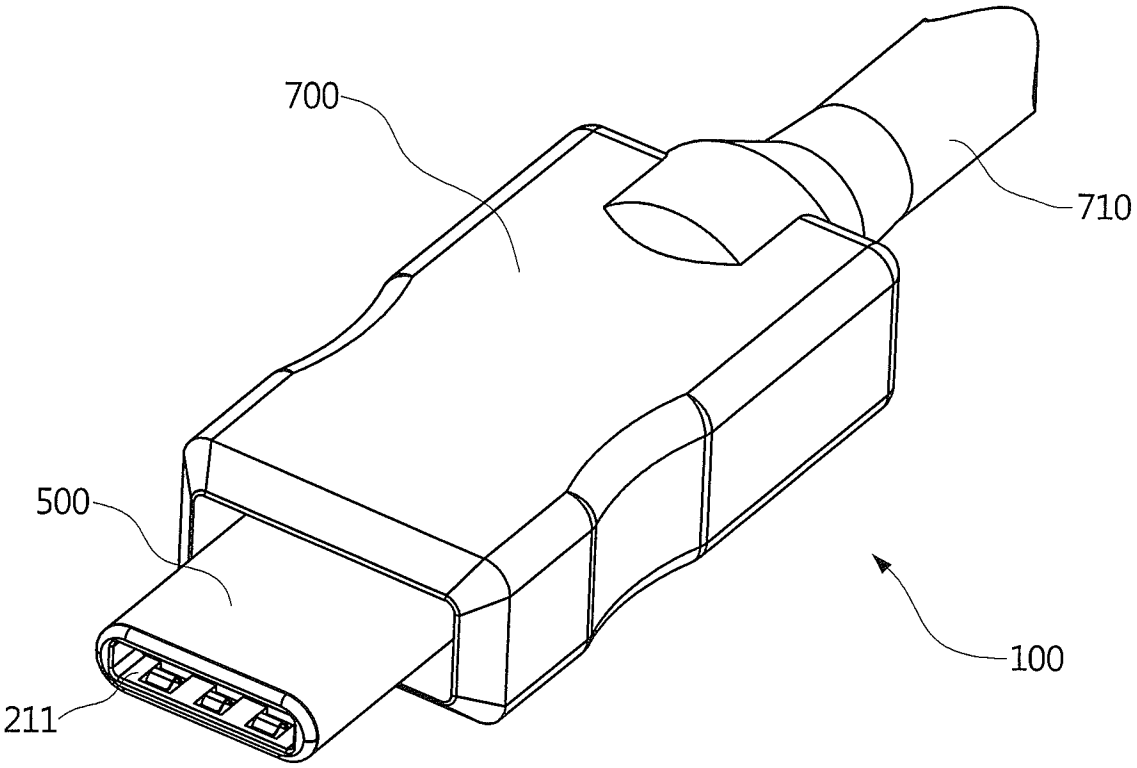
FIG. 1 is a schematic diagram of an electrical plug connector according to a preferred embodiment of the present invention.
Figure 2:
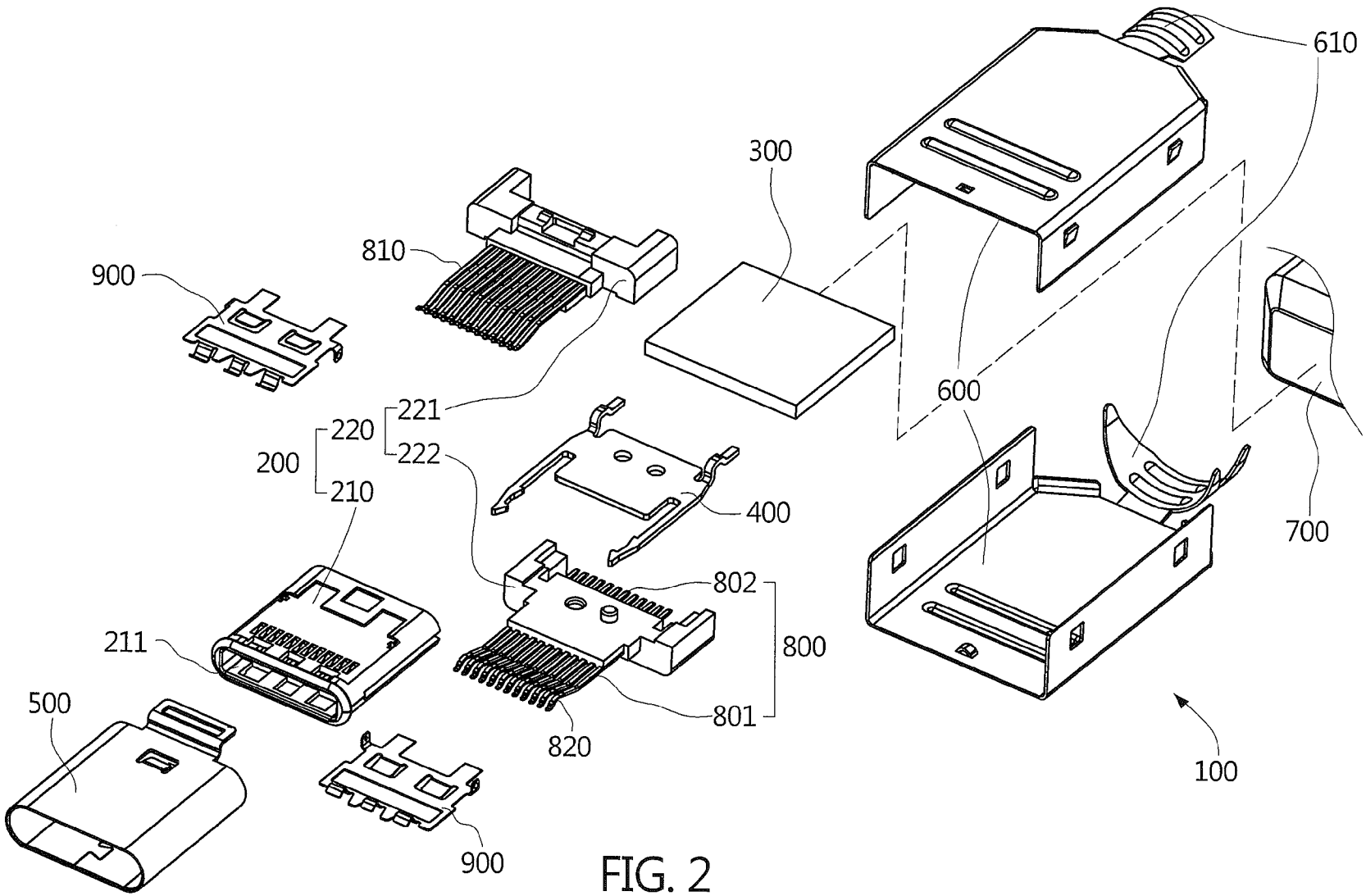
FIG. 2 is an exploded diagram of the electrical plug connector according to the preferred embodiment of the present invention.

Please refer to FIGS. 1 and 2. FIGS. 1 and 2 are a schematic diagram and an exploded diagram of an electrical plug connector according to a preferred embodiment of the present invention, respectively. An electrical plug connector 100 includes an insulating housing 200, two terminal sets, a circuit board 300, a metallic component 400, a metallic shell 500, an auxiliary metallic shell 600, an overcoat 700 and a cable (not shown). The insulating housing 200 includes a front portion 210 and a rear portion 220. The front portion 210 extends forwardly from the rear portion 220, and a receiving cavity 211 is formed inside the front portion 210. The front portion 210 includes an upper inner side, a left inner side, a lower inner side, and a right inner side. The upper, left, lower, and right inner sides surround and form the receiving cavity 211. The two terminal sets separately include a plurality of terminals 800. The two terminal sets are arranged in an upper-row terminal set 810 and a lower-row terminal set 820. The upper-row terminal set 810 and the lower-row terminal set 820 are symmetrical to each other about the center line of the receiving cavity 211 as the symmetrical center. In other words, the upper-row terminal set 810 can be rotated by 180° about the symmetrical center to fully match the lower-row terminal set 820 and vice versa. Each terminal 800 includes a contact portion 801, a retaining portion (not labeled); and a soldering portion 802. The contact portions 801 extend forwardly from the retaining portions, and the soldering portions 802 extend backwardly from the retaining portions. The retaining portions are retained in the insulating housing 200, the soldering portions 802 are disposed in the rear of the insulating housing 200, and the contact portions 801 are disposed in the receiving cavity 211. In the embodiment, the two terminal sets are high-speed terminals for high-speed data transmission.

Figure 3:
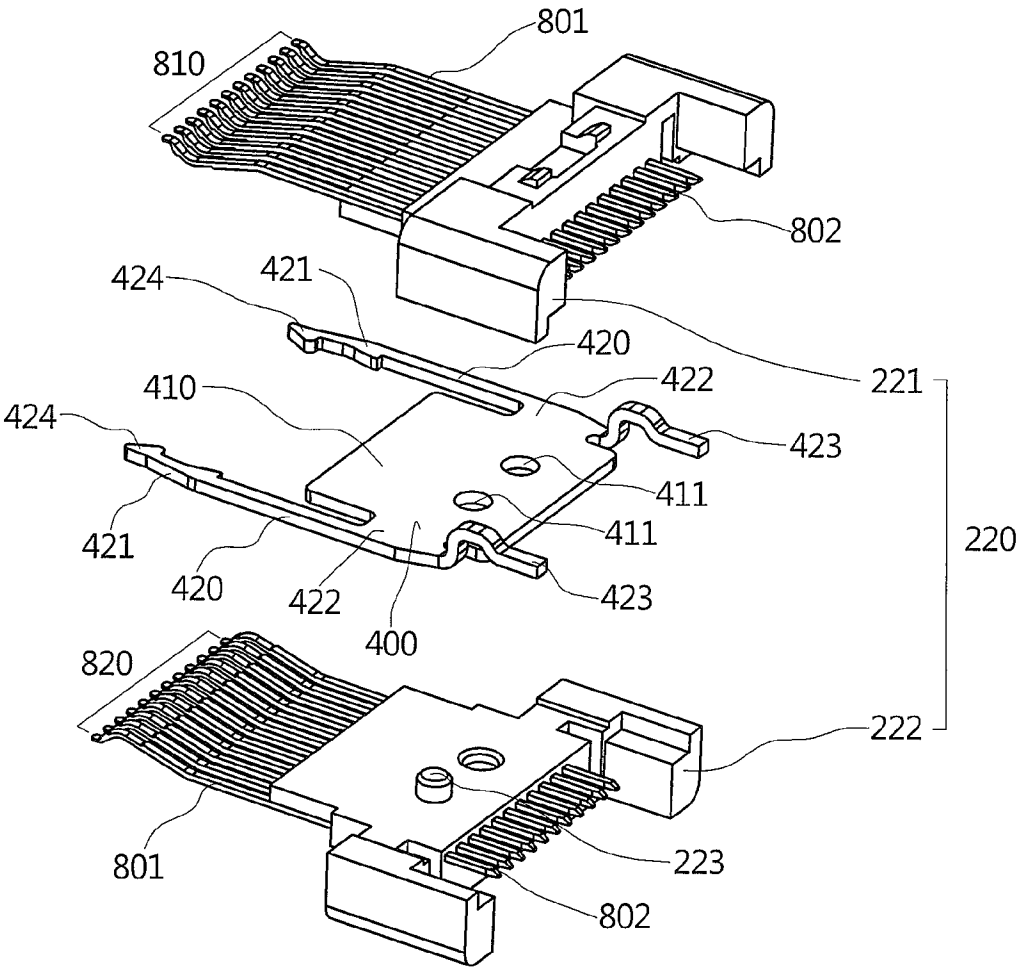
FIG. 3 is an exploded diagram of a rear portion and a metallic component according to the preferred embodiment of the present invention.

Please refer to FIG. 3. FIG. 3 is an exploded diagram of the rear portion 220 and the metallic component 400 in the embodiment. The rear portion 220 includes an upper rear portion 221 and a lower rear portion 222. The upper rear portion 221 and the lower rear portion 222 are assembled to each other. The retaining portions of the upper-row terminal set 810 are retained in the upper rear portion 221, and the retaining portions of the lower-row terminal set 820 are retained in the lower rear portion 222. In the embodiment, the upper rear portion 221 with the upper-row terminal set 810 and the lower rear portion 222 with the lower-row terminal set 820 are formed by, but are not limited to being formed by, using insert molding. The metallic component 400 includes a plate body 410 and two latches 420. The plate body 410 is disposed in the rear portion 220 and clamped between the upper rear portion 221 and the lower rear portion 222. The two latches 420 are separately disposed at two sides of the plate body 410 and symmetrical to each other. The plate body 410 and the two latches 420 are formed in one piece. Each latch 420 includes an engaging portion 421, a connecting portion 422, and a grounding portion 423. The connecting portions 422 are connected to the plate body 410, the engaging portions 421 extend forwardly from the connecting portions 422, and the grounding portions 423 extend backwardly from the connecting portions 422.

Figure 4:
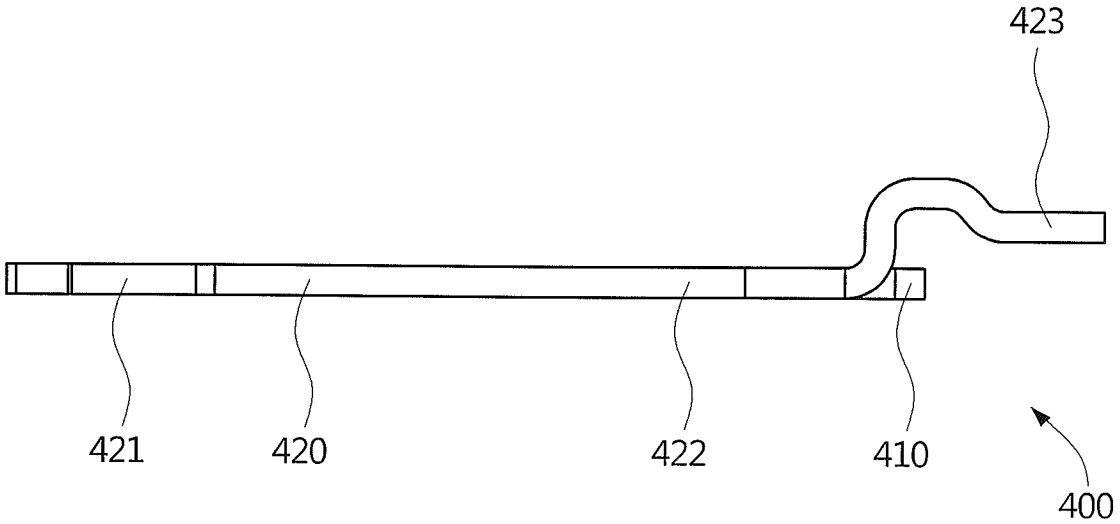
FIG. 4 is a side view of the metallic component according to the preferred embodiment of the present invention.

Please refer to FIGS. 3 and 4. FIG. 4 is a side view of the metallic component 400 in the embodiment. The plate body 410 and the two latches 420 are formed in a blanking-type component. In particular, the plate body 410, the connecting portions 422, and the engaging portions 421 are formed by using fine blanking and one-step molding rather than using a bending process, so that it has stronger mechanical strength and lower production costs. As shown in FIG. 4, the plate body 410, the connecting portions 422, and the engaging portions 421 are directly formed by using stamping molding, and therefore, as seen from the side view, the plate body 410, the connecting portions 422, and the engaging portions 421 are coplanar. In the embodiment, the grounding portions 423 are formed by using the bending process for the convenience of soldering. In other embodiments, the grounding portion may be formed without using the bending process, so that the whole of the metallic component including the plate body and the two latches are coplanar.

Figure 5:
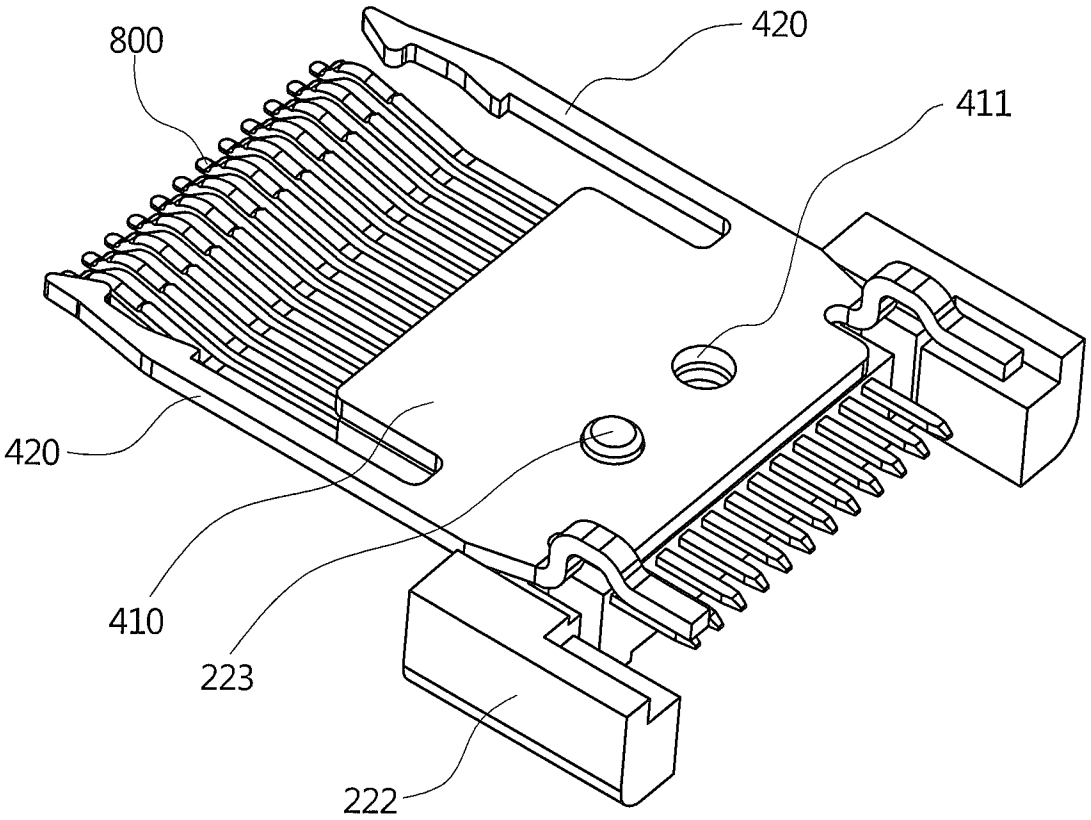
FIG. 5 is an assembled diagram of the metallic component and a lower rear portion according to the preferred embodiment of the present invention.
Figure 6:
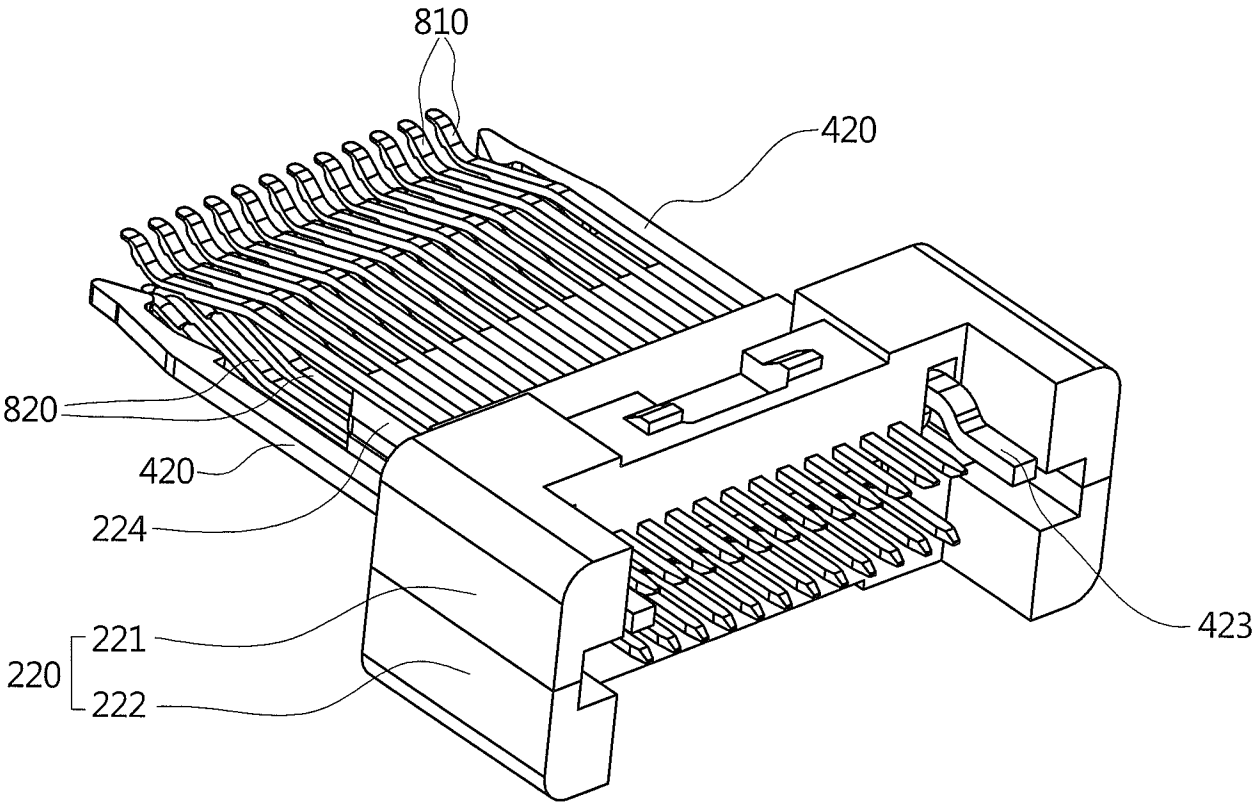
FIG. 6 is an assembled diagram of the rear portion and the metallic component according to the preferred embodiment of the present invention.
Figure 7:
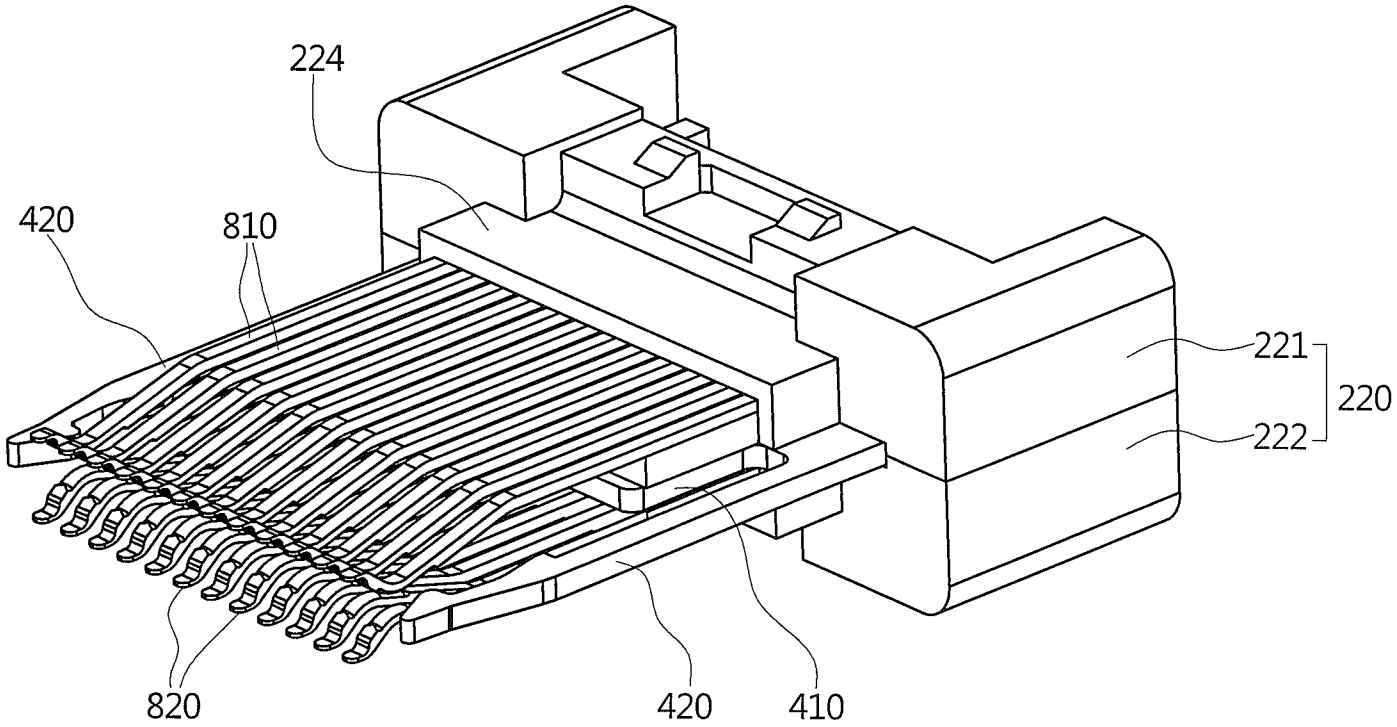
FIG. 7 is another view of the diagram shown in FIG. 6.

Please refer to FIGS. 3, 5, 6, and 7. FIG. 5 is an assembled diagram of the metallic component 400 and the lower rear portion 222 in the embodiment, FIG. 6 is an assembled diagram of the rear portion 220 and the metallic component 400 in the embodiment, and FIG. 7 is another view of the diagram shown in FIG. 6. The upper rear portion 221 includes an upper positioning post (not shown), the lower rear portion 222 includes a lower positioning post 223, and the plate body 410 includes two positioning holes 411. The upper positioning post and the lower positioning post 223 are separately disposed corresponding to the two positioning holes 411. When assembling, the two positioning holes 411 of the plate body 410 are aligned with the upper positioning post and the lower positioning post 223, and then the upper rear portion 221 and the lower rear portion 222 are assembled to each other, so that the upper positioning post and the lower positioning post 223 are separately inserted through the two positioning holes 411, and so that the plate body 410 is clamped between the upper rear portion 221 and the lower rear portion 222. As shown in FIG. 5, first, the metallic component 400 is assembled to the lower rear portion 222, and the lower positioning post 223 is inserted through one of the positioning holes 411 while the other of the positioning holes 411 is used to be inserted through by the upper positioning post. As shown in FIGS. 6 and 7, there are shown diagrams of the upper rear portion 221, the metallic component 400, and the lower rear portion 222 when assembling is completed. The plate body 410 is disposed in the rear portion 220 and retained between the upper-row terminal set 810 and the lower-row terminal set 820, so that the plate body 410 may shield and reduce crosstalk when signals are transmitted. Moreover, the metallic component 400, with the plate body 410 and the latches 420 being formed in one piece, may reduce production costs and simplify assembly processes.

Figure 8:
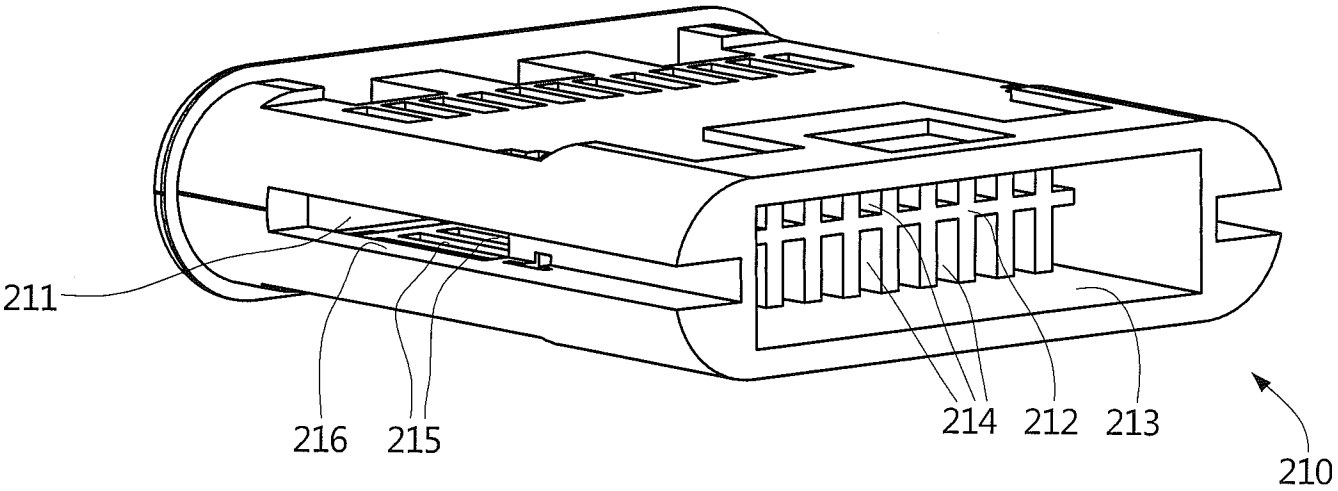
FIG. 8 is a schematic diagram of a front portion according to the preferred embodiment of the present invention.
Figure 9:
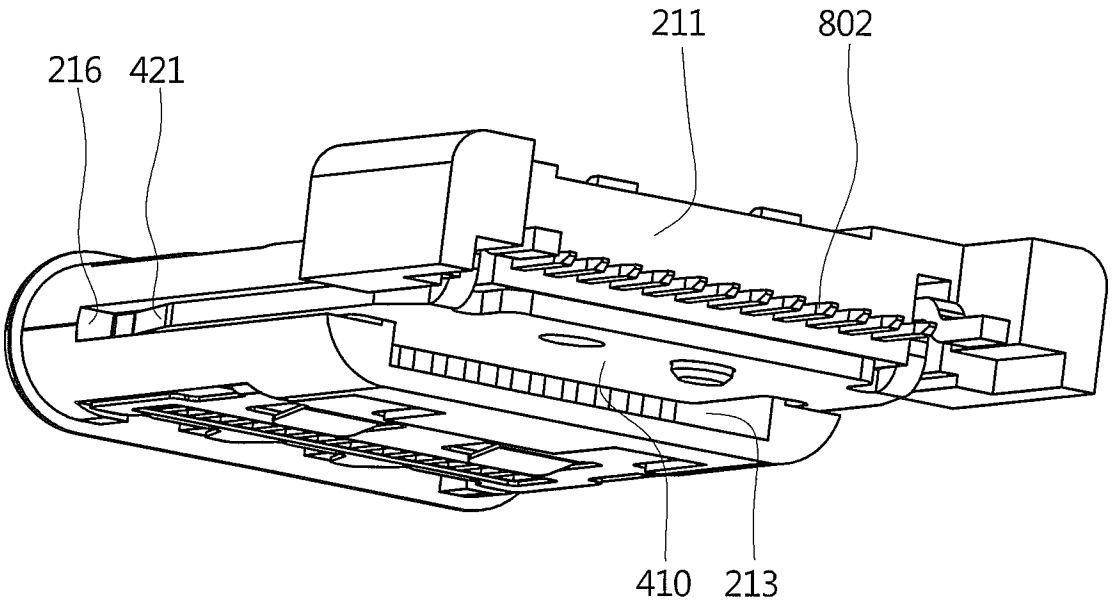
FIG. 9 is an assembled diagram of the front portion and the rear portion according to the preferred embodiment of the present invention, omitting the lower rear portion and a lower-row terminal set.

Please refer to FIGS. 8 and 9. FIG. 8 is a schematic diagram of the front portion 210 in the embodiment, and FIG. 9 is an assembled diagram of the front portion 210 and the rear portion 220 in the embodiment, in which FIG. 9 omits the lower rear portion 222 and the lower-row terminal set 820 for the convenience of illustration. A partition 212 and an accommodating cavity 213 are further formed inside the front portion 210. The partition 212 is disposed between the receiving cavity 211 and the accommodating cavity 213. A plurality of terminal channels 214 is disposed through the partition 212, and the terminal channels 214 communicate with the receiving cavity 211 and the accommodating cavity 213. As shown in FIGS. 6 and 7, the rear portion 220 includes a tongue 224 whose geometrical shape is complementary to that of the accommodating cavity 213. In the embodiment, the front portion 210 and the rear portion 220 are assembled to each other to form the insulating housing 200. When assembling, the tongue 224 is inserted into the accommodating cavity 213, so that the rear portion 220 is assembled to the front portion 210. Moreover, the terminals 800 of the upper-row terminal set 810 and the lower-row terminal set 820 retained in the rear portion 220 are separately disposed through the terminal channels 214, and the contact portions 801 of the terminals 800 are respectively disposed through the terminal channels 214.

Figure 10:
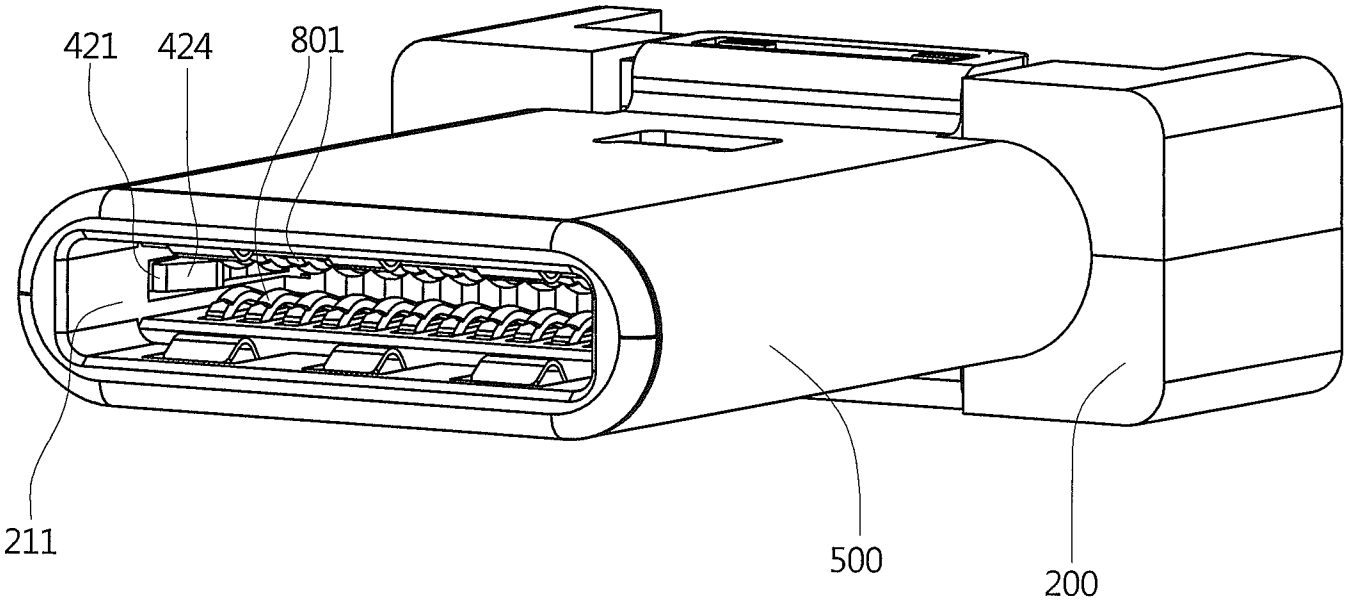
FIG. 10 is an assembled diagram of the front portion, the rear portion, and a metallic shell according to the preferred embodiment of the present invention.

Please refer to FIGS. 8, 9, and 10. FIG. 10 is a schematic diagram showing the lower rear portion 222, the lower-row terminal set 820, and the metallic shell 500 are further included, based on FIG. 9. A plurality of terminal slots 215 is disposed on the upper inner side and the lower inner side of the front portion 210. The terminal slots 215 separately communicate with the terminal channels 214. When the contact portions 801 of the terminals 800 go through the terminal channels 214 to project into the receiving cavity 211, some parts of the contact portions 801 are disposed in the terminal slots 215, and some other parts of the contact portions 801 project from the terminal slots 215 into the receiving cavity 211. In the embodiment, the contact portions 801 are in a spring arm type. The contact portions 801 of the upper-row terminal set 810 and the lower-row terminal set 820 are disposed on the upper inner side and the lower inner side, respectively. In other words, some parts of the contact portions 801 of the terminals 800 of the upper-row terminal set 810 are disposed in the terminal slots 215 on the upper inner side, and some parts of the contact portions 801 of the terminals 800 of the lower-row terminal set 820 are disposed in the terminal slots 215 on the lower inner side. As shown in FIGS. 8 and 9, the front portion 210 further includes two through-slots 216. The two through-slots 216 are separately disposed on and penetrate through the left inner side and the right inner side. When the front portion 210 and the rear portion 220 are assembled to each other, the two engaging portions 421 of the two latches 420 are separately disposed corresponding to the left inner side and the right inner side. That is, the two engaging portions 421 are separately disposed in the two through-slots 216. Moreover, as shown in FIGS. 3 and 10, each engaging portion 421 includes an engaging end 424. The two engaging ends 424 separately project into the receiving cavity 211 from the left inner side and the right inner side.

As shown in FIG. 10, when the assembly of the insulating housing 200 is completed, the contact portions 801 of the upper-row terminal set 810 and the lower-row terminal set 820 and the engaging portions 421 of the latches 420 are placed in correct positions, the contact portions 801 of the upper-row terminal set 810 and the lower-row terminal set 820 are disposed on the upper inner side and the lower inner side, respectively, and the two engaging portions 421 are separately disposed corresponding to the left inner side and the right inner side. The receiving cavity 211 corresponds to a mating electrical receptacle connector (not shown). When the electrical plug connector 100 is inserted into the mating electrical receptacle connector, a tongue of the electrical receptacle connector is inserted into the receiving cavity 211, and signal terminals disposed on upper and lower surfaces of the tongue of the electrical receptacle connector contact the contact portions 801 of the upper-row terminal set 810 and the lower-row terminal set 820 of the electrical plug connector 100. Because the contact portions 801 are in a spring arm type, the contact portions 801 may elastically contact the signal terminals disposed on the upper and lower surfaces of the tongue to have the good effect of electrically connection. In addition, grounding terminals disposed on left and right surfaces of the tongue of the electrical receptacle connector contact the engaging ends 424 of the engaging portions 421, and the engaging portions 421 may secure left and right sides of the tongue of the electrical receptacle connector, increasing the stability of the electrical plug connector 100 being inserted into the electrical receptacle connector. Furthermore, the metallic shell 500 sleeves the insulating housing 200, and the rear of the metallic shell 500 and the rear portion 220 are engaged with each other. Thus, the metallic shell 500 covers the insulating housing 200 to increase the whole of mechanical strength.

Figure 11:
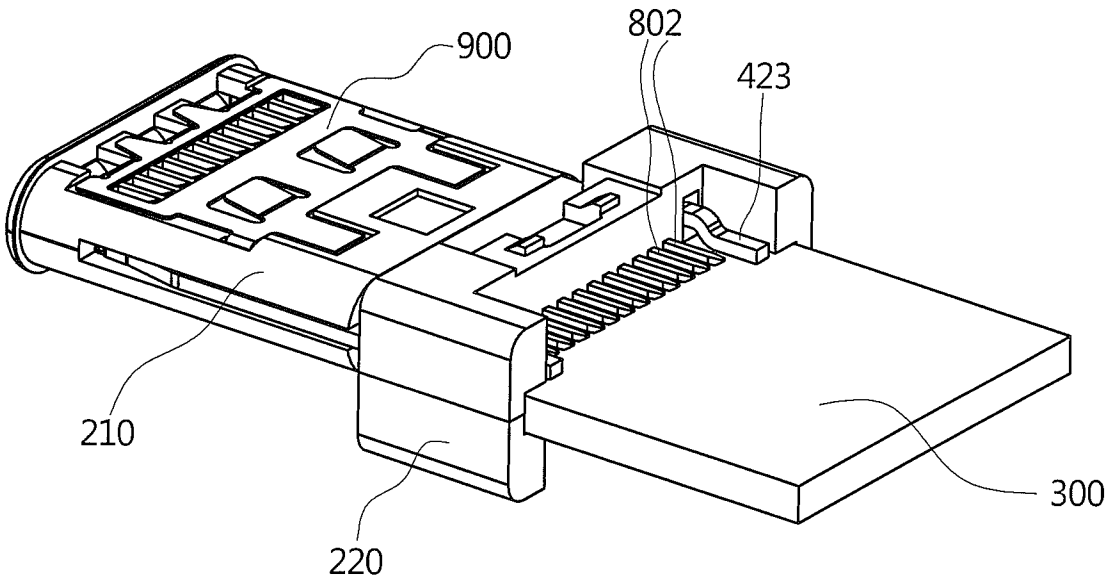
FIG. 11 is an assembled diagram of the front portion, the rear portion, and a circuit board according to the preferred embodiment of the present invention.

Please refer to FIG. 11. FIG. 11 is a schematic diagram showing the circuit board 300 is further included, based on FIG. 9. The circuit board 300 is placed between the soldering portions 802 of the upper-row terminal set 810 and the lower-row terminal set 820, and disposed in the rear of the rear portion 220. The soldering portions 802 are soldered on the circuit board 300. The grounding portions 423 of the latches 420 are disposed in the rear of the insulating housing 200 and disposed on a surface of the circuit board 300, and the grounding portions 423 are soldered to a grounding circuit on the circuit board 300. In other words, when the electrical plug connector 100 is connected with the electrical receptacle connector, the latches 420 may not only increase the stability of connection but also provide the function of grounding.

Please further refer to FIGS. 1 and 2. The front of the cable is soldered on the circuit board 300. The auxiliary metallic shell 600 includes a cable clamping portion 610 which is disposed in the rear of the auxiliary metallic shell 600. The auxiliary metallic shell 600 surrounds the soldering portions 802 of the upper-row terminal set 810 and the lower-row terminal set 820, the two grounding portions 423 of the two latches 420, and the circuit board 300. The cable clamping portion 610 clamps the cable and is used to keep the cable retained tightly. The front of the auxiliary metallic shell 600 is engaged with the rear of the metallic shell 500. The overcoat 700 includes a pipe portion 710 which is disposed in the rear of the overcoat 700. The overcoat 700 encloses the auxiliary metallic shell 600. The cable 310 is disposed through the pipe portion 710.

Figure 14:
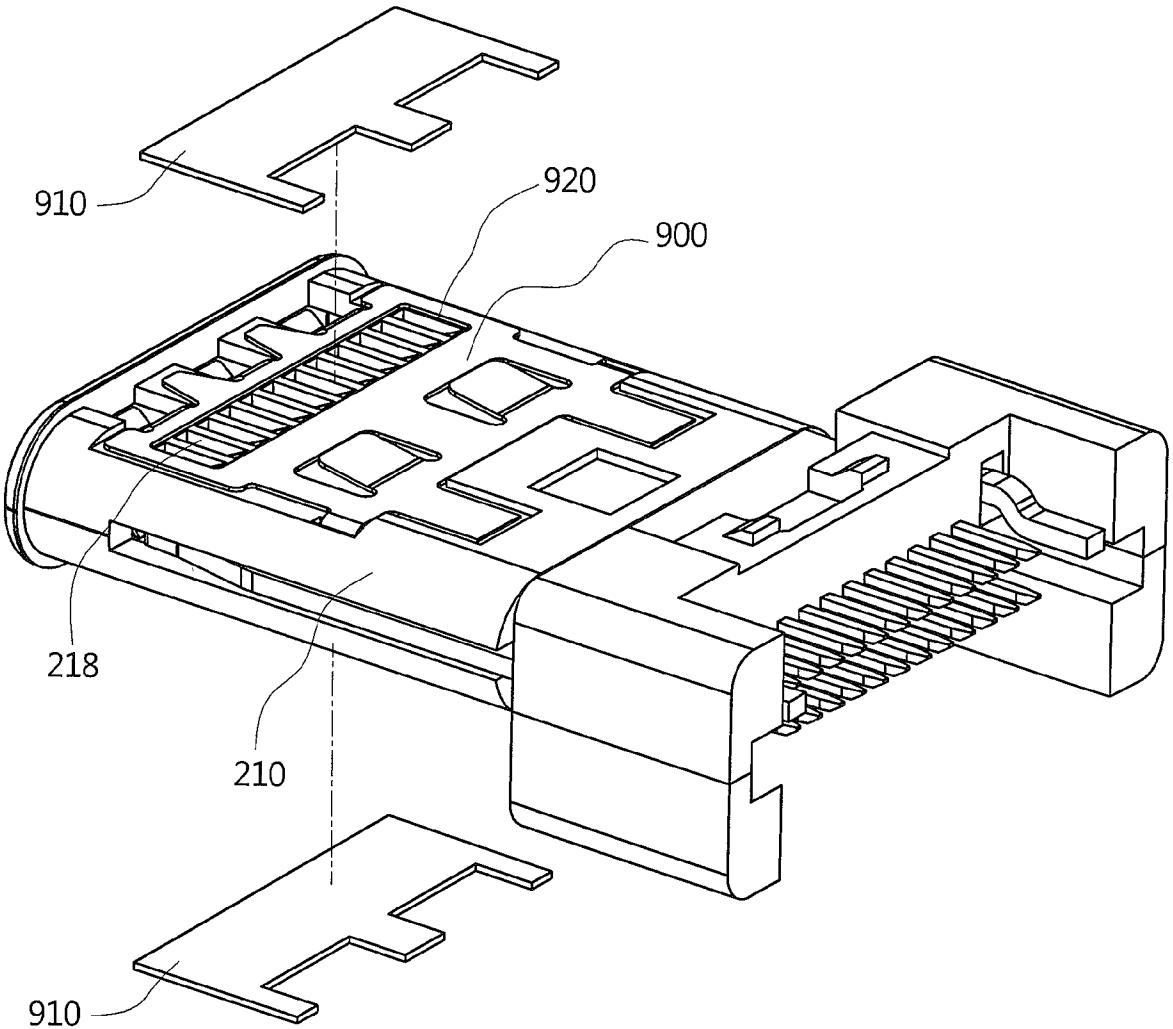
FIG. 14 is a schematic diagram of two metallic plates each having a film disposed thereon according to the preferred embodiment of the present invention.

Furthermore, as shown in FIGS. 2, 11, and 14, two metallic plates 900 are separately disposed on upper and lower outer sides of the front portion 210 and used to increase the mechanical strength of the front portion 210. When the electrical plug connector 100 is inserted into the electrical receptacle connector, the contact portions 801 of the terminals 800 are forced to bend outwardly. To prevent the bent contact portions 801 from pressing against the front portion 210 to cause excessive resistance, a plurality of through-holes 218 is formed on the front portion 210 to provide space for the contact portions 801 to be bent, and an opening 920 is formed on each metallic plate 900 and corresponding to the through-holes 218 to avoid the bent contact portions 801 being blocked. To prevent the bent contact portions 801 from contacting the metallic shell 500 to cause a short circuit, a film 910 is disposed on a surface of each metallic plate 900 facing away from the front portion 210 to cover the opening 920. The film 910 is, for example, a Mylar film which is commonly used in the field.

In other embodiments, the electrical plug connector may be changed to a plug-type storage device. The plug-type storage device may remove the auxiliary metallic shell, the overcoat and the cable. Instead, the plug-type storage device may further include a memory disposed on the circuit board, and be covered by an appearance component.

Figure 12:
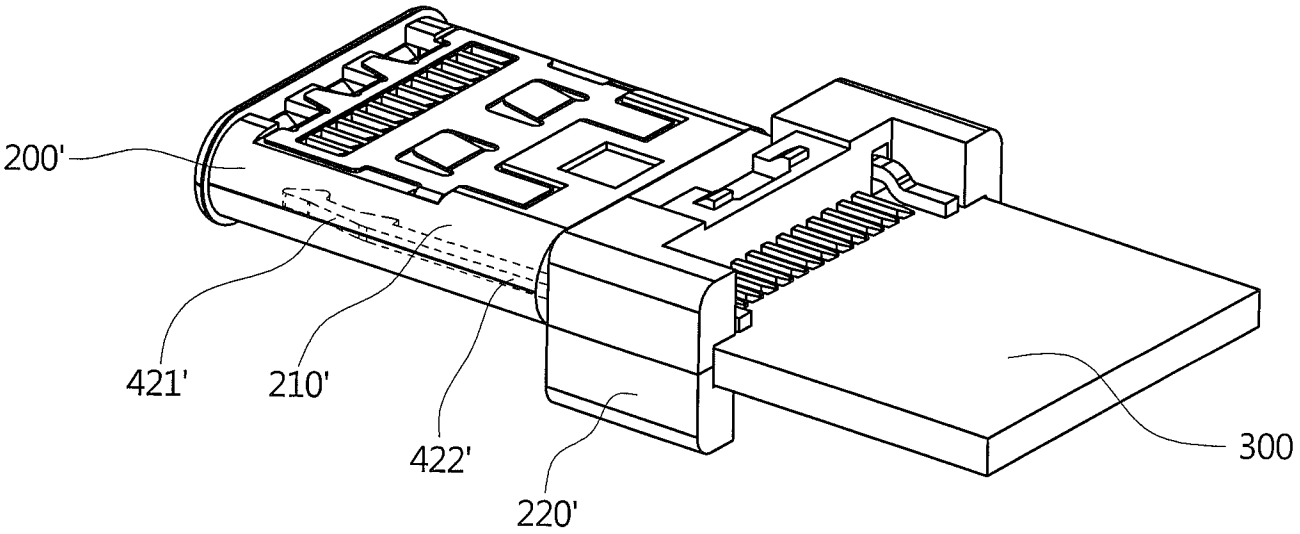
FIG. 12 is a schematic diagram of an insulating housing and a metallic component according to another preferred embodiment of the present invention.

Please refer to FIG. 12. FIG. 12 is a schematic diagram of an insulating housing 200', the circuit board 300, and a metallic component (not labeled) according to another preferred embodiment of the present invention. FIG. 12 is based on the insulating housing 200, the circuit board 300, and the metallic component 400 shown in FIGS. 1 through 11, and the structure and process of the insulating housing 200 and the metallic component 400 are slightly amended. In the embodiment, the front portion 210' of the insulating housing 200' does not include the through-slots 216. The metallic component in the embodiment is formed in the rear portion 220' by using insert molding. When the insert molding process is completed, the connecting portions 422' of the metallic component is embedded in the rear portion 220', the engaging portions 421' of the metallic component project into the receiving cavity (not labeled) formed in the front portion 210', and the two engaging portions 421' are separately adjacent to the left inner side and the right inner side of the front portion 210'.

Figure 13:
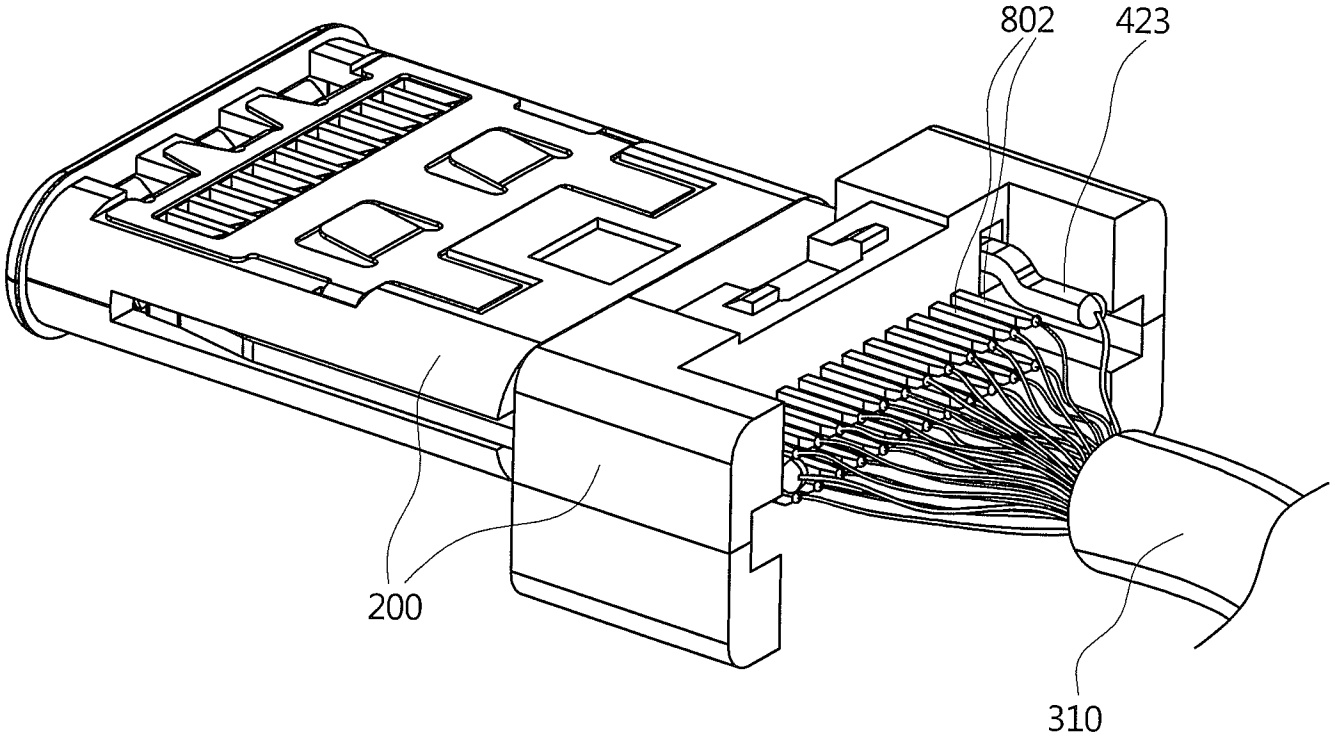
FIG. 13 is a schematic diagram of an insulating housing, terminals, latches, and a cable according to yet another preferred embodiment of the present invention.

Please refer to FIG. 13. FIG. 13 is a schematic diagram of the insulating housing 200, the terminals 800, the latches 420, and a cable 310 according to yet another preferred embodiment of the present invention. FIG. 13 is based on the insulating housing 200, the terminals 800, the latches 420 and the circuit board 300 shown in FIGS. 1 through 11, and the cable 310 is further included to replace the circuit board 300 in the embodiment. The cable 310 includes a plurality of wires. The wires are directly soldered to the soldering portions 802 of the terminals 800 and the two grounding portions 423 of the latches 420, to reduce the whole of volume.

It will be apparent to those skilled in the art that various modifications and variations can be made to the structure of the present invention without departing from the scope or spirit of the present invention. In view of the foregoing, it is intended that the present invention cover modifications and variations of this invention provided they fall within the scope of the following claims and their equivalents.

What is claimed is:

1. An electrical plug connector comprising:

an insulating housing comprising a front portion and a rear portion, wherein the front portion extends forwardly from the rear portion, wherein a receiving cavity is formed inside the front portion, wherein the front portion comprises an upper inner side, a left inner side, a lower inner side, and a right inner side, which surround and form the receiving cavity;

two terminal sets separately comprising a plurality of terminals, wherein the two terminal sets are arranged in an upper-row terminal set and a lower-row terminal set, wherein each terminal comprises a contact portion, a retaining portion, and a soldering portion, wherein the retaining portions are retained in the insulating housing, the soldering portions are disposed in the rear of the insulating housing, and the contact portions are disposed in the receiving cavity, wherein the contact portions of the upper-row terminal set and the lower-row terminal set are disposed on the upper inner side and the lower inner side respectively; and a metallic component comprising a plate body and two latches, wherein the plate body is disposed in the rear portion and retained between the upper-row terminal set and the lower-row terminal set, wherein the two latches are separately disposed at two sides of the plate body, wherein each latch comprises an engaging portion and a connecting portion, wherein the connecting portions of the two latches are connected to the plate body, wherein the engaging portions of the two latches project into the receiving cavity and are separately disposed corresponding to the left inner side and the right inner side, wherein the plate body and the two latches are coplanar.

2. The electrical plug connector of claim 1, wherein the contact portions are in a spring arm type.

3. The electrical plug connector of claim 1 further comprising a cable which comprises a plurality of wires soldered to the soldering portions and the two grounding portions.

4. The electrical plug connector of claim 1, further comprising two metallic plates separately disposed on upper and lower outer sides of the front portion.

5. The electrical plug connector of claim 4, further comprising a film disposed on a surface of each metallic plate and facing away from the front portion.

6. The electrical plug connector of claim 1, wherein the upper-row terminal set and the lower-row terminal set are symmetrical to each other about a center line of the receiving cavity as the symmetrical center.

7. The electrical plug connector of claim 6, wherein the two latches are symmetrical to each other.

8. The electrical plug connector of claim 7, wherein each latch further comprises a grounding portion, and wherein the grounding portions of the two latches are disposed in the rear of the insulating housing.

9. The electrical plug connector of claim 8 further comprising a circuit board, a metallic shell, an auxiliary metallic shell, and an overcoat, wherein the circuit board is placed between the soldering portions of the upper-row terminal set and the lower-row terminal set, wherein the grounding portions of the two latches are disposed on a surface of the circuit board, wherein the metallic shell covers the insulating housing, wherein a rear of the metallic shell and the rear portion are engaged with each other, wherein a front of a cable is adapted to be soldered on the circuit board, wherein the auxiliary metallic shell comprises a cable clamping portion which is disposed in a rear of the auxiliary metallic shell, wherein the auxiliary metallic shell surrounds the soldering portions of the plurality of terminals, the grounding portions of the two latches, and the circuit board, wherein the cable clamping portion is adapted to clamp the cable, wherein a front of the auxiliary metallic shell is engaged with the rear of the metallic shell, wherein the overcoat comprises a pipe portion which is disposed in a rear of the overcoat, wherein the overcoat encloses the auxiliary metallic shell, and wherein the cable is adapted to be disposed through the pipe portion.

10. The electrical plug connector of claim 8, wherein the plate body and the two latches are formed in one piece and are formed as a blanking-type component.

11. The electrical plug connector of claim 1, wherein the rear portion comprises an upper rear portion and a lower rear portion, which are assembled to each other, wherein the retaining portions of the upper-row terminal set and the lower-row terminal set are retained in the upper rear portion and the lower rear portion respectively, and wherein the plate body is clamped between the upper rear portion and the lower rear portion.

12. The electrical plug connector of claim 10, wherein the front portion comprises two through-slots which are separately disposed on the left inner side and the right inner side, wherein the two engaging portions are separately disposed in the two through-slots, and wherein each engaging portion comprises an engaging end which projects into the receiving cavity.

13. An electrical plug connector comprising:

an insulating housing comprising a front portion and a rear portion, wherein the front portion extends forwardly from the rear portion, wherein a receiving cavity is formed inside the front portion, wherein the front portion comprises an upper inner side, a left inner side, a lower inner side, and a right inner side, which surround and form the receiving cavity;

two terminal sets separately comprising a plurality of terminals, wherein the two terminal sets are arranged in an upper-row terminal set and a lower-row terminal set, wherein each terminal comprises a contact portion, a retaining portion, and a soldering portion, wherein the retaining portions are retained in the insulating housing, the soldering portions are disposed in the rear of the insulating housing, and the contact portions are disposed in the receiving cavity, wherein the contact portions of the upper-row terminal set and the lower-row terminal set are disposed on the upper inner side and the lower inner side respectively; and a metallic component comprising a plate body and two latches, wherein the plate body is disposed in the rear portion and retained between the upper-row terminal set and the lower-row terminal set, wherein the two latches are separately disposed at two sides of the plate body, wherein each latch comprises an engaging portion and a connecting portion, wherein the connecting portions of the two latches are connected to the plate body, wherein the engaging portions of the two latches project into the receiving cavity and are separately disposed corresponding to the left inner side and the right inner side, wherein the rear portion comprises an upper rear portion and a lower rear portion, which are assembled to each other, wherein the retaining portions of the upper-row terminal set and the lower-row terminal set are retained in the upper rear portion and the lower rear portion respectively, wherein the plate body is clamped between the upper rear portion and the lower rear portion, wherein the upper rear portion comprises an upper positioning post and the lower rear portion comprises a lower positioning post, wherein the plate body comprises two positioning holes, and wherein the upper positioning post and the lower positioning post are separately inserted through the two positioning holes.

14. An electrical plug connector comprising:

an insulating housing comprising a front portion and a rear portion, wherein the front portion extends forwardly from the rear portion, wherein a receiving cavity is formed inside the front portion, wherein the front portion comprises an upper inner side, a left inner side, a lower inner side, and a right inner side, which surround and form the receiving cavity;

two terminal sets separately comprising a plurality of terminals, wherein the two terminal sets are arranged in an upper-row terminal set and a lower-row terminal set, wherein each terminal comprises a contact portion, a retaining portion, and a soldering portion, wherein the retaining portions are retained in the insulating housing, the soldering portions are disposed in the rear of the insulating housing, and the contact portions are disposed in the receiving cavity, wherein the contact portions of the upper-row terminal set and the lower-row terminal set are disposed on the upper inner side and the lower inner side respectively; and a metallic component comprising a plate body and two latches, wherein the plate body is disposed in the rear portion and retained between the upper-row terminal set and the lower-row terminal set, wherein the two latches are separately disposed at two sides of the plate body, wherein each latch comprises an engaging portion and a connecting portion, wherein the connecting portions of the two latches are connected to the plate body, wherein the engaging portions of the two latches project into the receiving cavity and are separately disposed corresponding to the left inner side and the right inner side, wherein the connecting portions of the two latches are embedded into the insulating housing, wherein the engaging portions of the two latches are disposed in the receiving cavity, and wherein the engaging portions of the two latches are separately adjacent to the left inner side and the right inner side.

15. The electrical plug connector of claim 14, wherein the upper-row terminal set and the lower-row terminal set are symmetrical to each other about a center line of the receiving cavity as the symmetrical center.

16. The electrical plug connector of claim 15, wherein the two latches are symmetrical to each other.

17. The electrical plug connector of claim 16, wherein each latch further comprises a grounding portion, and wherein the grounding portions of the two latches are disposed in the rear of the insulating housing.

18. The electrical plug connector of claim 17, wherein the plate body and the two latches are formed in one piece and are formed as a blanking-type component.

19. An electrical plug connector comprising:

an insulating housing comprising a front portion and a rear portion, wherein the front portion extends forwardly from the rear portion, wherein a receiving cavity is formed inside the front portion, wherein the front portion comprises an upper inner side, a left inner side, a lower inner side, and a right inner side, which surround and form the receiving cavity;

two terminal sets separately comprising a plurality of terminals, wherein the two terminal sets are arranged in an upper-row terminal set and a lower-row terminal set, wherein each terminal comprises a contact portion, a retaining portion, and a soldering portion, wherein the retaining portions are retained in the insulating housing, the soldering portions are disposed in the rear of the insulating housing, and the contact portions are disposed in the receiving cavity, wherein the contact portions of the upper-row terminal set and the lower-row terminal set are disposed on the upper inner side and the lower inner side respectively; and a metallic component comprising a plate body and two latches, wherein the plate body is disposed in the rear portion and retained between the upper-row terminal set and the lower-row terminal set, wherein the two latches are separately disposed at two sides of the plate body, wherein each latch comprises an engaging portion and a connecting portion, wherein the connecting portions of the two latches are connected to the plate body, wherein the engaging portions of the two latches project into the receiving cavity and are separately disposed corresponding to the left inner side and the right inner side, wherein a partition and an accommodating cavity are further formed inside the front portion, wherein the partition is disposed between the receiving cavity and the accommodating cavity, wherein a plurality of terminal channels is disposed through the partition, wherein the plurality of terminal channels communicates with the receiving cavity and the accommodating cavity, wherein the rear portion comprises a tongue which is inserted into the accommodating cavity, and wherein the plurality of terminals is separately disposed through the plurality of terminal channels.

20. The electrical plug connector of claim 19, wherein a plurality of terminal slots is disposed on the upper inner side and the lower inner side, wherein the plurality of terminal slots separately communicates with the plurality of terminal channels, wherein some parts of the contact portions of the plurality of terminals are disposed in the terminal slots, and some other parts of the contact portions of the plurality of terminals project from the plurality of terminal slots into the receiving cavity.

* * * * *